US007192151B2

(12) United States Patent
Clupper et al.

(10) Patent No.: US 7,192,151 B2
(45) Date of Patent: Mar. 20, 2007

(54) LIGHT ARRAY FOR A SURGICAL HELMET

(75) Inventors: Christian H. Clupper, Columbia City, IN (US); Timothy G. Vendrely, Fort Wayne, IN (US); Danny E. McAdams, Warsaw, IN (US); Leon Huntsman, Kimmell, IN (US)

(73) Assignee: DePuy Products, Inc., Warsaw, IN (US)

( * ) Notice: Subject to any disclaimer, the term of this patent is extended or adjusted under 35 U.S.C. 154(b) by 9 days.

(21) Appl. No.: 11/018,332

(22) Filed: Dec. 21, 2004

(65) Prior Publication Data

US 2006/0133069 A1 Jun. 22, 2006

(51) Int. Cl.
*F21V 21/064* (2006.01)
*A42C 5/04* (2006.01)

(52) U.S. Cl. ..... 362/105; 362/294; 2/906; 2/171.3

(58) Field of Classification Search ..... 362/105–106, 362/800, 294
See application file for complete search history.

(56) References Cited

U.S. PATENT DOCUMENTS 5,355,285 A 10/1994 Hicks
5,667,292 A 9/1997 Sabalvaro, Jr.
5,769,523 A 6/1998 Feinbloom
6,017,049 A * 1/2000 Spector ..... 280/288.4
6,120,161 A 9/2000 Van Der Bel
6,224,227 B1 5/2001 Klootz
6,585,727 B1 7/2003 Cashman et al.
6,601,985 B1 8/2003 Jesurum et al.
6,719,437 B2 * 4/2004 Lary et al. ..... 362/106
6,808,289 B2 10/2004 Reed
6,814,463 B2 11/2004 Mele
6,935,761 B2 * 8/2005 Vanderschuit ..... 362/106
6,955,444 B2 * 10/2005 Gupta ..... 362/105
2005/0174753 A1 * 8/2005 Cao et al. ..... 362/106

FOREIGN PATENT DOCUMENTS

WO WO 0207632 A1 1/2002
WO WO 02/099332 A1 12/2002

OTHER PUBLICATIONS

Lumens, Elektro, "FT-3C LED flashlight", © Daniel Rutter 1998-2004, http://www.dansdata.com/ft3c.htm, 7 pages).
"LED Clusters, Arrays, Assemblies", © The LED Light.com: The Future of Lighting http://www.theledlight.com/led-clusters.html, Dec. 9, 2004, 4 pages.
"How to Hook Up LEDs", LSDiodes.com, http://www.lsdiodes.com/tutorial/, © 2003LSDiodes.com, 5 pages.

* cited by examiner

*Primary Examiner*—Ali Alavi
(74) *Attorney, Agent, or Firm*—Maginot, Moore & Beck

(57) ABSTRACT

A surgical head gear apparatus or helmet includes a lighting system that utilizes circuit board mounted LED clusters supported on the surgical helmet. The LED clusters are part of a light array mounted to the forward portion of the helmet. In one embodiment, the light array is self-contained with its own power supply. In another embodiment, the light array is electrically connected to an external power supply and controller, such as en existing controller associated with the ventilation system of the helmet. In accordance with the invention, the only remote link for the LED clusters and circuit boards is to a control switch and/or power supply.

19 Claims, 4 Drawing Sheets

LIGHT ARRAY FOR A SURGICAL HELMET

BACKGROUND OF THE INVENTION

The present invention is directed to a head gear apparatus or helmet for use with a garment worn by a medical caregiver during surgical procedures.

In many surgical procedures, medical personnel wear garments that are intended to maintain a barrier between the personnel and the patient. This barrier helps maintain sterile conditions in the operating room by completely shrouding the medical personnel and their clothing. In addition, this barrier serves to protect the caregiver from exposure to blood and other body fluids. Various organizations, such as OSHA, promulgate recommendations regarding occupational exposure to fluid-borne pathogens during medical procedures. The surgical gown or shroud helps meet these recommendations.

One such surgical gown, or personal protection system, is the PROVISION™ System, marketed by DePuy Orthopaedics Co., Inc. This system includes a helmet system that integrates with a barrier hood and gown. The hood and gown are composed of a HYTREL® elastomer (provided by DuPont deNemours) that allows heat to escape while maintaining a fluid-impervious barrier. In addition to the gown material, a face shield or bubble is provided to allow the caregiver a protected view of the surgical arena.

The helmet system supports at least the barrier hood. Since the medical caregiver is essentially encased within the hood and gown, ventilation is of critical importance for air supply, $CO_2$ discharge, heat control and anti-fogging. Thus, the helmet component of the PROVISION™ System includes an air moving and filtration system. The system draws ambient air through a filter assembly and directs the filtered air through vents formed in the helmet. In the PROVISION™ System, air is directed across the face of the wearer and across the face shield. The air mover is an electric fan that connects to an external power supply and speed control worn about the waist of the caregiver.

Certain aspects of the PROVISION™ System are described in U.S. Pat. No. 6,393,617, assigned to the owner of the present invention. The specification and figures of this application are incorporated herein by reference. Improvements to the PROVISION™ System are described in co-pending application Ser. No. 10/622,527, filed on Jul. 18, 2003, and entitled "Head Gear Apparatus". This application, which is owned by the assignee of the present invention, discloses a helmet, such as the helmet 10 shown in FIGS. 1–2 of the present application. For the purposes of the present disclosure, only certain features of that helmet are described herein, it being understood that other details of the system are found in the aforementioned application, the disclosure and figures of which are incorporated herein by reference.

The helmet 10 includes a body or shell 12 that is configured to fit over the head of a wearer. The helmet is stabilized by an adjustable strap assembly (not shown) that is pivotably attached to the helmet shell. The strap assembly includes an arrangement to straps and adjustment mechanisms that engage the head of the wearer. A chin bar 14 that extends from the forward portion of the helmet underneath the chin of the wearer. The chin bar helps support the lower edge of a face shield (not shown) that encloses the face opening 16. The helmet and chin bar are configured to preferably removably support the face shield to facilitate cleaning or replacement.

The helmet shell 12 is hollow to provide conduits for ventilation air flow generated by a fan assembly 25 mounted to the back of the helmet 10. The shell includes a forward ventilation duct 18 that passes over the crown of the wearer's head and curves downward so that the ventilation opening 19 (FIGS. 2–3) is directed over the face of the wearer. A deflector plate 20 is slidably disposed within the duct 18 to controllably divide the air flow between the face plate and the wearer's face. An adjustment knob 21 on the top of the helmet facilitates this adjustment. The shell also defines a rear ventilation duct 23 with similar flow adjustment capabilities.

The fan assembly 25 includes an air filter open to the ambient air when the helmet 10 and associated surgical garment are worn. The assembly further includes a motor and a fan element (not shown) that are connected by control wires 27 to an external controller and power supply 28. Preferably, the controller 28 is configured to be supported at waist level of the wearer, such as on a belt, so that the controller is readily accessible to activate, de-activate or adjust air flow rates.

In many surgical settings, ambient lighting is inadequate at the immediate surgical site. For instance, when close work is required the surgeon's shadow may impair visibility. Surgical headlights were developed to address this problem by providing a light source immediately adjacent the surgeon's head. Early surgical headlights were akin to a miner's helmet with an incandescent bulb mounted on a headpiece. One disadvantage of this approach was the heat generated by the bulb. To address this problem, a light pipe was provided between an optical assembly supported on the surgeon's head and a light source, such as an incandescent bulb, mounted remote from the surgeon. In one such system disclosed in U.S. Pat. No. 5,355,285, the light source and a flexible light pipe are supported on the ceiling of the operating room whereby the surgeon can tap into the light pipe.

While the remote mounted light source and light pipe system solved the problem of over-heating, it added the problem of restricted mobility since the surgeon was tethered to the light pipe and source. In answer to this problem, the light source has been configured to be carried by the surgeon, as described in PCT Publication WO 02/099332 A1, published on Dec. 12, 2002. A fiber optic cable connects the light source to a light projector mounted on a headpiece. Although this lighting system overcomes the problem of being tethered to a remote light source, it retains the prior art problem of adding significant weight to the surgical helmet system. This added weight increases neck fatigue of the surgeon and adds inertia to the helmet that makes head movements more cumbersome. Moreover, this type of light system adds the significant expense of a fiber optic cable to transmit light from the light source to the light projector.

What is needed is a lighting system for use with a surgical helmet that provides accurate illumination of the surgical work site without the detriments of the prior lighting systems, such as weight, expense and heat build-up.

SUMMARY OF THE INVENTION

To address this need, the present invention contemplates a surgical head gear apparatus or helmet comprises a shell configured to be worn on the head of a person, the shell having a forward portion adjacent the face of the person wearing the shell. A light array is supported on the forward portion of the shell, the light array including at least one LED light source and control wires for carrying electrical current to the LED light source. A power supply is provided that is connected to the control wires to energize the light source. Preferably, the light array includes two LED light sources, each situated above an eye of the wearer so that the light beam produced by the LED light source is aligned with the viewing field of the wearer.

The light array includes a housing to support each light source relative to the shell. The light array also includes a mounting element spanning between and connected to the housing for each of the light sources with means for supporting the mounting element on the forward portion of the shell. In the preferred embodiment, the means for supporting includes machine screws passing through bores in the mounting element and engaged within threaded bores in the helmet shell.

In one aspect of the invention, the LED light sources are self-contained, meaning that they are not connected to a separate light source via a light pipe of fiber optic cable. To that end, each LED light source includes a plurality of LEDs connected to a circuit board. The circuit board is electrically connected to a power supply and/or a controller. The circuit board defines wiring patterns for energizing each of the LEDs connected to the board in a conventional manner. Alternatively, the circuit board may define multiple circuit patterns to permit selective activation of the LEDs. In the preferred embodiment, the LEDs are 5 mm white LEDs, although other colors are contemplated.

The light array of the present invention is particularly suited for use on a surgical helmet having a ventilation system. Thus, in one embodiment, the helmet includes a ventilation duct associated with the shell and having a ventilation opening at the forward portion of the shell. A fan assembly supported by the shell is operable to direct air flow through the ventilation duct. In this embodiment, the fan assembly and light array are electrically connected to a common power supply and/or controller.

According to a further embodiment of the invention, a surgical helmet comprises a shell configured to be worn on the head of a person, the shell having a forward portion adjacent the face of the person wearing the shell, and a self-contained light array supported on the forward portion of the shell. In one feature of this embodiment, the light array includes at least one LED light source and a power supply to energize the light source. Preferably, the light array includes two LED light sources with a housing for each of the light sources. A mounting element spans between and is connected to the housing for each of the light sources and includes means for supporting the mounting element on the forward portion of the shell. The mounting element houses the power supply, which is preferably a battery. Where the battery is replaceable, the mounting element includes a door to access the battery.

It is one object of the invention to provide a lighting system for use with a surgical head gear apparatus and associated surgical garment. It is a further object to provide a lighting system that is light weight to avoid fatigue for the wearer.

A further object of the invention is to provide a lighting system that is not tethered to a light or power source. Another object resides in features of the lighting system that make it self-contained within the surgical helmet. Other objects and specific benefits of the invention will be made apparent upon consideration of the following written description along with the accompanying figures.

DESCRIPTION OF THE PREFERRED EMBODIMENTS

Figure 1:
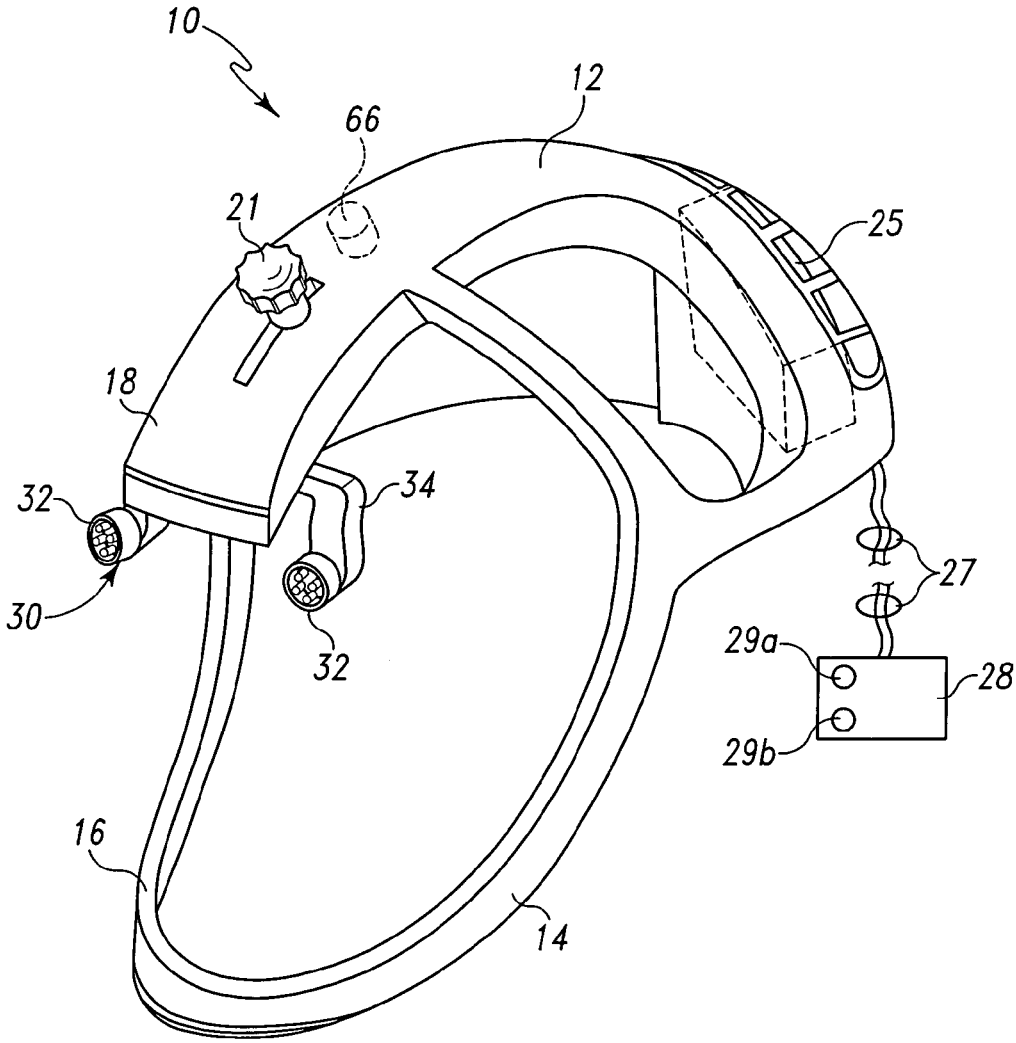
FIG. 1 is a perspective view of a surgical helmet instrumented with a light array in accordance with one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
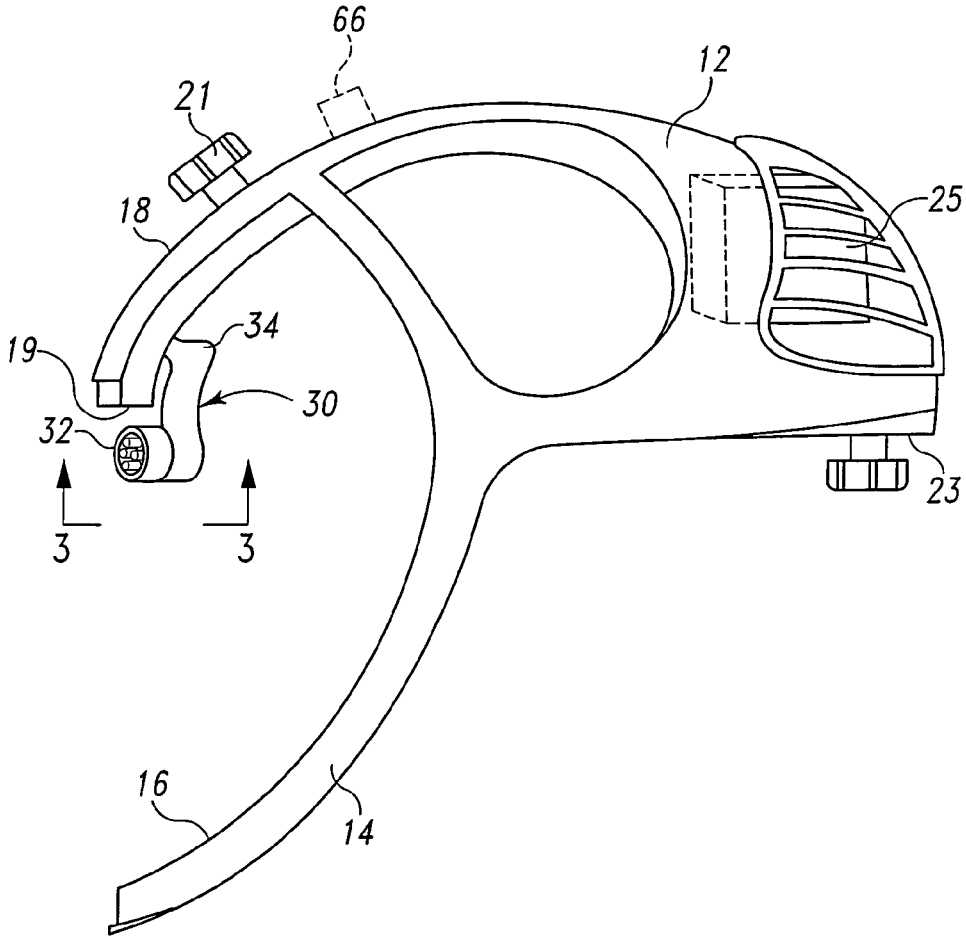
FIG. 2 is a side view of the surgical helmet shown in FIG. 1.
Figure 4:
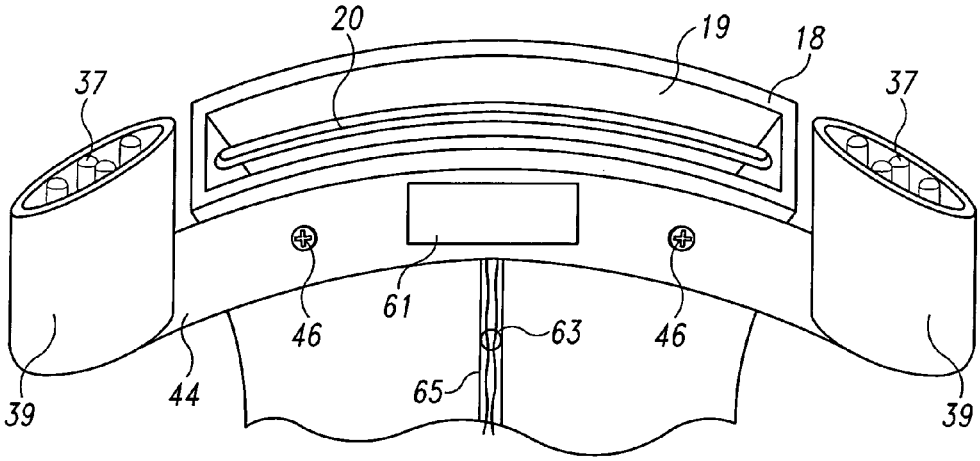
FIG. 4 is a bottom partial view of the surgical helmet shown in FIG. 1 with the light array of the present therein mounted thereon.
Figure 5:
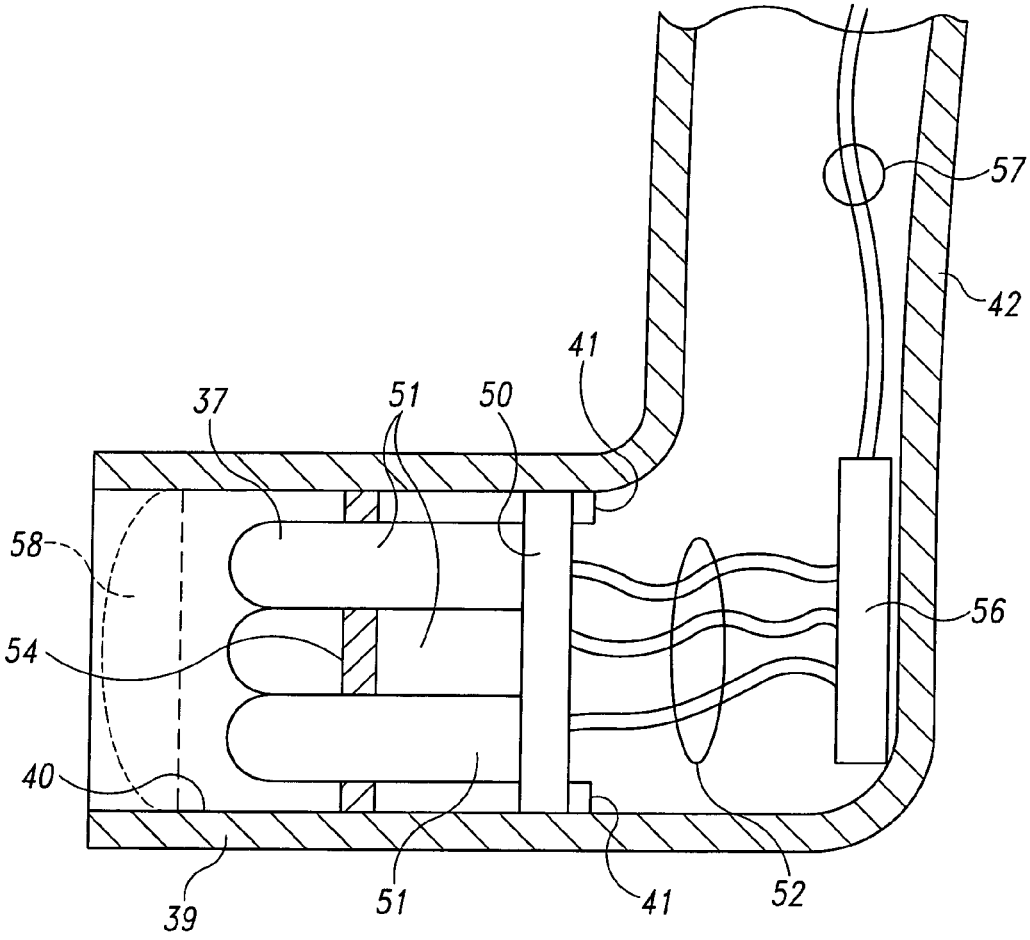
FIG. 5 is a side cross-sectional view of a portion of the light array shown in the prior figures.

A shown in the detail view of FIG. 4, the present invention contemplates a light array 30 that is adapted to be mounted on a surgical helmet, such as the helmet 10 shown in FIGS. 1–2. The light array 30 includes a pair of light sources 32 situated on either side of the helmet 10, and particularly on the opposite sides of the ventilation duct 18, as shown in FIG. 1. The light sources 32 are carried by a mounting element 34 that anchors the light array to the helmet 10. The mounting element defines a pair of housings 39, each for supporting a corresponding light source 32. Each housing is connected to a mounting bracket 44 by an associated arm 42. The arms 42 are preferably sized to support the light sources 32 below the ventilation opening 19 at the forward end of the duct 18, but above the eyes of the medical personnel wearing the helmet 10.

The mounting bracket 44 is provided with mounting holes 45 (FIG. 4) to receive fasteners 46 (FIG. 3) for affixing the bracket to the underside of the helmet ventilation duct 18. In the preferred embodiment, the bracket is mounted to the helmet by machine screws. However, other means for supporting the mounting bracket on the helmet are contemplated, such as adhesive, clamping, or snap-fit, and may even include integrally forming the bracket with the helmet shell. Preferably, the light array 30 is configured to be removably mounted to the helmet for easy servicing and/or replacement; however, permanent or semi-permanent attachment of the array to the helmet is also contemplated.

In accordance with one aspect of the invention, the light array 30 comprises an LED cluster 37 which includes at least one, and preferably a plurality, of LEDs 51. The LEDs can be of any known design and in any color appropriate to facilitate visibility at a surgical site. In a specific embodiment, the LEDs are 5 mm 50° white light LEDs with a luminous intensity of about 1800 mcd. It is contemplated that colors other than white may be utilized, such as amber, to augment the ambient light and improve the visibility and clarity of the illuminated area. In a specific embodiment, the LEDs are 5 mm 50° white light LEDs with a luminous intensity of about 1800 mcd.

The number of LEDs 51 provided in the array 37 may be used to determine the intensity of the light. For instance, an 18 LED cluster of the 5 mm white LEDs can put out the equivalent of a 15 watt incandescent light bulb. A 30 watt LED cluster requires about 36 of these standard LEDs with an overall package dimension of about 2½" diameter and ⅝" height. Arrays 37 with fewer or greater numbers of LEDs will be proportionately lesser or greater in diameter, but the overall package height will not change (although different color LEDs may be taller).

The number and type of LEDs 51 in an array 37 is determined by the desired beam intensity, beam width, electrical power requirement, heat generation and space availability. The standard white LED operates at 3.5–5 V and 20–35 milliamps so it is well suited to being powered by a typical 12 volt DC power supply. The proximity of the light sources 32 to the ventilation opening 19 facilitates heat dissipation from the LED clusters 37. Where the light array 30 is intended to augment the existing lighting, the beam intensity and width can be smaller.

The LEDs 51 of the cluster 37 are preferably surface mounted on a base 50. A circuit board 56 operates as the opto-electric controller for the LEDs to interface with the electrical power supply. The circuit board can be of known design adapted to control the activation of the LEDs. Typically, the LED cluster and circuit board will be obtained from a vendor in a common package. In one embodiment, the base 50 and circuit board 56 are combined into a single printed circuit board with the surface mounted LEDs. In another embodiment, the circuit board 56 is separate from the base 50 within the housing cavity 40, with the LED leads 52 communicating between the LEDs and the circuit board.

The LED cluster 37 may be mounted within the cavity 40 in any known manner. In one specific embodiment the circuit board 56 is mounted to an interior surface of the housing arm 42 while the support base 50 is engaged to tabs 41 within the cavity 40. Typically, the LED cluster and circuit board will be obtained from a vendor in a common package. Thus, the configuration of the housing 39 and cavity 40 is adapted to accommodate the vendor hardware.

The cluster may also include a seal 54 that provides a moisture tight seal around the LEDs 51. The seal may also include a reflective surface to increase the luminous intensity of the light source 32. In addition, a lens 58 may be mounted at the opening of the housing 39. The lens can be configured to focus or diffuse the combined light beams from the LED cluster.

Figure 3:
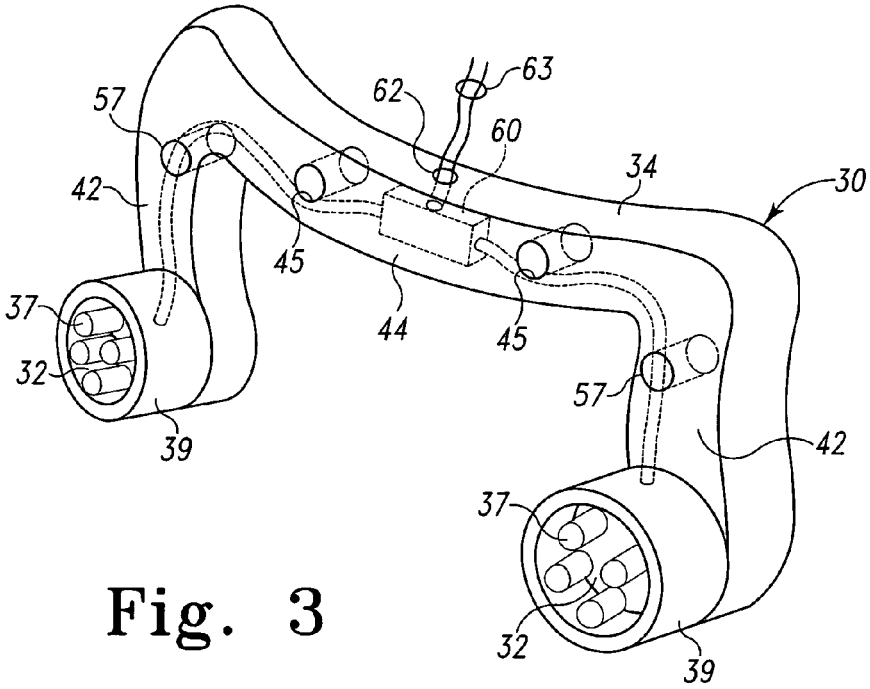
FIG. 3 is a front perspective view of the light array shown in FIGS. 1–2.

In the preferred embodiment of the invention, the light sources 32 are powered through the electrical system for the ventilation fan assembly 25. In this embodiment, the circuit boards 56 includes control wires 57 that are fed through the arms 42 and mounting element 34. In one embodiment, the control wires 57 meet at a junction box 60 within the mounting element. The junction box 60 is fed by control wires 63 that exit the mounting element 34 through an opening 62. Preferably the opening 62 is sealed, such as by a grommet through which the wires pass. As shown in FIG. 3, the control wires 63 pass along the forward ventilation duct 18 of the helmet, most preferably through a channel 65 formed in the helmet.

In this embodiment, the control wires 63 are directed through the helmet and integrated into the control wires for the fan assembly 25 at the rear of the helmet. In one specific embodiment, the light source control wires 63 are spliced directly into the control wires feeding the fan assembly, so that operation of the light array 30 is directly tied to operation of the fan. Another approach is to run the control wires 63 together with the control wires for the fan assembly into a wiring bundle 27 that is connected to the power supply and controller 28. With this embodiment, the controller 28 can be adapted for separate control of the ventilation and lighting systems. For instance, separate control switches or buttons 29*a*, 29*b* can be provided to selectively activate the fan and light source, respectively. Since it is unnecessary to provide variable voltage to the LEDs 51 of the light array, the switch 29*b* may be a simple on-off push-button or toggle. The power supply portion of the controller 28 is preferably a battery or battery array capable of providing the necessary voltage and current to simultaneously power the fan assembly 25 and the light array 30. At a minimum, the power supply must be capable of generating 5 volts at 35 milliamps to drive each LED 51.

In an alternative embodiment, the junction box 60 may incorporate a power supply or battery within the mounting element so that the light array 30 is a self-contained lighting device. The mounting element 34 may be provided with an access door 61 to permit replacement of the power supply. With this embodiment, the control wires 63 may be simply connected to an external switch to activate or deactivate the power supply. The activation switch can comprise the switch 29*b* on the external controller 28. The switch may be placed on the mounting element 34, although manipulation of the switch would require access inside the helmet while it is being worn. As a further alternative, a switch 66 can be mounted on the helmet itself, such as adjacent the adjustment knob 21 used to control the ventilation air flow through the ventilation opening 19, as shown in dashed lines in FIGS. 1–2. Preferably this switch 66 is a push-button on-off switch that can be easily depressed through the surgical garment covering the helmet to permit ready control of the light array during a surgical procedure.

The light array 30 of the present invention provides a light weight solution to the lighting problem experienced in many surgical settings. The mounting element 34 and housing 39 are preferably formed of a light-weight plastic. Since the light array does not function as a structural element of the helmet 10, strength and durability of the plastic material are not essential features. Preferably, the mounting element and housing are integrally molded and hollow throughout. These components of the light array can be formed as halves that can be joined after the light source 32 and its associated components have been installed.

In the illustrated embodiment, the housings 39 for the two light sources 32 have a predetermined orientation. The mounting bracket 34 and arms 42 shown in FIGS. 1–2 are configured to mate with the particular helmet 10 shown in those figures to support the light sources in that predetermined orientation. Thus, the bracket and arms are sized and configured in a specific example so that the light sources are slightly outboard of the wearer's eyes with the "line of sight" of the sources coinciding with the line of vision of the wearer. The particular orientation of the light sources, as well as the configuration of the mounting bracket and arms, may be varied to account for the structure of the helmet to which the light array 30 is mounted, the desired line of sight of the light sources, the intensity and width of the beam of light generated by the sources 32, and even the viewing preferences of the wearer.

In the illustrated embodiment, the orientation of the light sources is fixed relative to the helmet 10. In an alternative embodiment, the orientation of the light sources can be adjustable in multiple degrees of freedom. For instance, the arms 42 can be configured to extend/retract and/or pivot to change the position of each light source relative to the eye of the wearer. Thus, the arms 42 can be telescoping and/or pivotably attached to the mounting element 34. In yet another alternative embodiment, the arms can be formed of a bendable material to permit infinite adjustment of the light beams from the sources 32.

It is known that light intensity of an LED cannot be adjusted. However, the overall light intensity of the LED clusters 37 can be varied by selectively activating the LEDs 51. For this alternative embodiment, the circuit board 56 is configured to allow activation of all or some predetermined combination of the LEDs 51 connected thereto. The printed circuit board 56 may include a wiring pattern that provides several separate circuits connecting selected ones of the LEDS, with each separate circuit having its own set of control wires among the wires 57. The switch 29*b* on the external power supply and controller 28 in this embodiment would be capable of different settings based on the luminous intensity resulting from activation of the separate circuits. For example, in one specific embodiment, the LED cluster 37 includes eighteen 5 mm white LEDs capable of a combined output of 15 watts. Energizing twelve of these LEDs reduces the output to 9 watts, while a 6 watt output results from nine LEDs. The printed circuit board 56 may define three circuits permitting selective activation of 9, 12 or all 18 of the LEDs.

The present invention preferably contemplates the use of white LEDs. However, under certain circumstances, a differently colored LED cluster may be preferred, such an arrangement of amber LEDs. Due to differences in current draw among differently colored LEDs it is recommended that all LEDs in a cluster have the same color. However, in a modification of the selectable LED circuits, independent circuits can be provided on the circuit board 56 to drive different "sub-clusters" of LEDs, each sub-cluster comprising LEDs of one color that is different from the color of the LEDs in the other sub-clusters. In this instance, the switch 29*b* may allow the wearer to switch the color of the illuminating light.

The illustrated embodiment contemplates two light sources straddling the centerline of the helmet 10. Most preferably, the light sources are arranged to reside above the eyes of the wearer but far enough removed to fall generally outside the upper peripheral vision. Alternatively a single light source or more than two light sources can be provided, with appropriate changes to the configuration of the mounting element 34 and arms 42 to ensure that the light sources fall within the confines of the helmet and face shield and are not too close to the face of the wearer.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A surgical helmet comprising:

a shell configured to be worn on the head of a person, said shell having a forward portion adjacent the face of the person wearing the shell;

a light array supported on said forward portion of said shell, said light array including at least one LED light source and control wires for carrying electrical current to said at least one LED light source;

a power supply connected to said control wires to energize the light source;

a ventilation duct associated with said shell and having a ventilation opening at said forward portion of said shell; and a fan assembly supported by said shell and operable to direct air flow through said ventilation duct, said fan assembly electrically connected to said power supply.

2. The surgical helmet of claim 1, wherein said light array includes two LED light sources.

3. The surgical helmet of claim 2, wherein said light array includes a housing for each one of said two light sources to support each light source adjacent a corresponding eye of the person wearing the shell.

4. The surgical helmet of claim 3, wherein said light array includes a mounting element spanning between and connected to the housing for each of said two light sources and means for supporting said mounting element on said forward portion of said shell.

5. The surgical helmet of claim 1, wherein said LED light source includes a plurality of LEDs connected to a circuit board.

6. The surgical helmet of claim 1, wherein said power supply is separate from said shell.

7. The surgical helmet of claim 1, wherein said light array includes said power supply.

8. The surgical helmet of claim 7, wherein said power supply is a battery.

9. A head gear assembly, comprising:

a head gear structure configured to be supported on a head of a person;

a ventilation duct associated with said head gear structure and having a ventilation opening;

a fan assembly supported by said head gear structure and operable to direct air flow through said ventilation duct;

a light array supported by said head gear structure and including at least one LED light source, said at least one LED light source being positioned adjacent to said ventilation opening; and a power supply operable to energize said light source.

10. The assembly of claim 9, wherein:

said ventilation duct has (i) a first lateral side located on a first side of said ventilation opening, and a second lateral side located on a second side of said ventilation opening which is opposite said first side of said ventilation opening, said light array includes a first LED light source and a second LED light source, said first LED light source is positioned adjacent to said first lateral side of said ventilation duct, and said second LED light source is positioned adjacent to said second lateral side of said ventilation duct.

11. The assembly of claim 9, wherein said light array includes:

a mounting structure including (i) a first arm, (ii) a second arm, and (iii) a central member extending therebetween, a first LED light source supported by said first arm, a second LED light source supported by said second arm, and a wire assembly having (i) a first portion extending between said first LED light source and said power supply, and (ii) a second portion extending between said second LED light source and said power supply.

12. The assembly of claim 11, wherein:

said mounting structure is a hollow mounting structure, and said wire assembly is at least partially located within said hollow mounting structure.

13. The assembly of claim 9, wherein:

said head gear structure includes a forward portion and a rearward portion, and said ventilation opening of said ventilation duct is positioned at said forward portion of said head gear structure.

14. The assembly of claim 9, wherein:

said head gear structure includes a shell, said shell defines said ventilation duct.

15. The assembly of claim 14, wherein said fan assembly is supported by said shell.

16. The assembly of claim 9, wherein said light array includes:

a mounting structure including (i) a first arm, (ii) a second arm, and (iii) a central member extending therebetween, a first plurality LEDs supported on said first arm, a second plurality LEDs supported on said second arm, and a wire assembly having (i) a first wire segment extending between said first plurality of LEDs and said power supply, and (ii) a second wire segment extending between said second plurality of LEDs and said power supply.

17. The assembly of claim 16, wherein:

said mounting structure is a hollow mounting structure, and said first wire segment and said second wire segment are each at least partially located within said hollow mounting structure.

18. The assembly of claim 16, wherein said light array further includes:

a first cylindrical housing encircling said first plurality of LEDs, and a second cylindrical housing encircling said second plurality of LEDs.

19. The assembly of claim 18, wherein:

said first cylindrical housing is located at a lower end of said first arm, and said second cylindrical housing is located at a lower end of said second arm.

* * * * *